United States Patent [19]

Sedille

[11] 4,159,738

[45] Jul. 3, 1979

[54] FAN-ASSISTED FORCED FLOW AIR-COOLING HEAT EXCHANGER SYSTEM

[75] Inventor: Marcel Sedille, Paris, France

[73] Assignee: Societe des Condenseurs Delas S.A., Paris, France

[21] Appl. No.: 775,686

[22] Filed: Mar. 8, 1977

[30] Foreign Application Priority Data

Mar. 8, 1976 [FR] France ..... 76 06528

[51] Int. Cl.[2] ..... F28F 13/06

[52] U.S. Cl. ..... 165/125; 165/DIG. 1

[58] Field of Search ..... 165/125, 129, 47, DIG. 1, 165/122; 261/109, DIG. 11

[56] References Cited

U.S. PATENT DOCUMENTS 2,907,554 10/1959 Heller ..... 165/125

3,689,367 9/1972 Kassat et al. ..... 261/DIG. 11

3,800,861 4/1974 Flitner ..... 261/DIG. 11

FOREIGN PATENT DOCUMENTS 43409 6/1938 Netherlands ..... 165/129

*Primary Examiner*—Samuel Scott

*Assistant Examiner*—Theophil W. Streule, Jr.

*Attorney, Agent, or Firm*—Sughrue, Rothwell, Mion, Zinn and Macpeak

[57] ABSTRACT

The invention relates to assisted flow ventilation heat exchanger systems which comprise heat exchangers disposed at the bottom of a cooling tower with a fan assisted flow and wherein the exchangers are disposed in such a way that they fulfill a distributor function for the fan, i.e. they provide an angular momentum to the cooling fluid which is such as to counteract the angular momentum provided by the fan.

5 Claims, 8 Drawing Figures

FAN-ASSISTED FORCED FLOW AIR-COOLING HEAT EXCHANGER SYSTEM

FIELD OF THE INVENTION

The present invention relates to an improvement to a system for heat exchange between a first fluid flowing inside ducts of a system of heat exchangers and a second fluid passing over the outside surfaces of the heat exchangers in a forced flow or assisted flow provided by a fan placed in a chimney downstream from the exchangers in relation to the flow direction of the second fluid.

In particular the inventon applies to forced flow or assisted flow "air-condenser" or "air-cooling" exchange systems using a fan.

BACKGROUND OF THE INVENTION

In order to improve the efficiency of a fan, it is known to provide it on the upstream side with a fixed system of vanes called a distributor, or on the downstream side with fixed system of vanes called a corrector, so that the fluid which has been taken in without any rotation will also be discharged without any rotation, or without any appreciable rotation.

However the presence of this system entails disadvantages: firstly, it increases the cost of the fan, secondly, it causes a noise like a siren due to the periodic passage of the mobile blades of the fan in front of the fixed vanes of the distributor or of the corrector and lastly, it causes losses of head, however small they may be, by friction which is added to the losses of head of the second fluid on passing over the outside walls of the heat exchanger.

Preferred embodiments of the present invention mitigate these disadvantages.

The present invention provides an improvement to a system for heat exchange between a first fluid flowing inside ducts of a set of heat exchangers and a second fluid passing over the outside surfaces of the heat exchangers in a forced flow or assisted flow provided by a fan placed in a chimney downstream from the heat exchangers in relation to the flow direction of the second fluid, wherein the heat exchangers are placed at the bottom of and round the chimney and are so oriented that the streams of the second fluid emerging from the heat exchangers form on the average, in a plane perpendicular to the axis of rotation of the fan, an angle $\alpha$ with the local radii emanating from the meeting point of said axis with said perpendicular plane, said angle $\alpha$ being calculated so that during average operation of the assembly, the angular momentum of said second fluid in relation to the axis of the fan, at the output of the heat exchangers, is substantially equal but in the opposite direction to the angular momentum imparted to said second fluid by the rotation of the fan, such that the angular momentum resulting from the second fluid in relation to the axis of the fan will be close to zero at the output of the fan.

There has thus been produced as assisted flow heat exchange system in which the heat exchangers are also used, in addition to their heat exchange function, as distributors for the fan by means of a judicious orientation of the heat exchange elements.

Doing this requires one distributor less and hence the extra loss of head due to this distributor and the siren noise which it causes are minimised, while the advantage of a fan with a distributor which enables it to discharge the fluid without any rotation or without any appreciable rotation in the chimney is maintained, thus improving the efficiency.

According to a particular embodiment of the invention the heat exchangers are substantially horizontal finned tube heat exchangers and they are disposed round the chimney in such a way that the fins guide the fluid at said angle $\alpha$.

According to another embodiment of the invention the heat exchangers are vertical tube heat exchangers and are disposed so that a perpendicular drawn in the mid plane of the heat exchanger will form said angle $\alpha$ with the radius ending at the foot of this perpendicular.

According to another embodiment, the heat exchangers are disposed in pairs around the base of the chimney in such a way that a pair of heat exchangers will be contiguous along their vertical side, and the mid plane of the dihedral formed by the two heat exchangers will form said angle $\alpha$ with a local radius ending in the vicinity of the middle of the arc covered by the two heat exchangers.

According to another embodiment of the invention, the heat exchangers are disposed in pairs around the base of the chimney, each pair being composed by two heat exchangers of different dimensions disposed on two sides of a triangle whose third side is formed by a part of the periphery of the base of the chimney.

BRIEF DESCRIPTION OF THE DRAWINGS

Embodiments of the invention are described by way of example with reference to the accompanying drawings in which.

DESCRIPTION OF THE PREFERRED EMBODIMENTS

Figure 1:
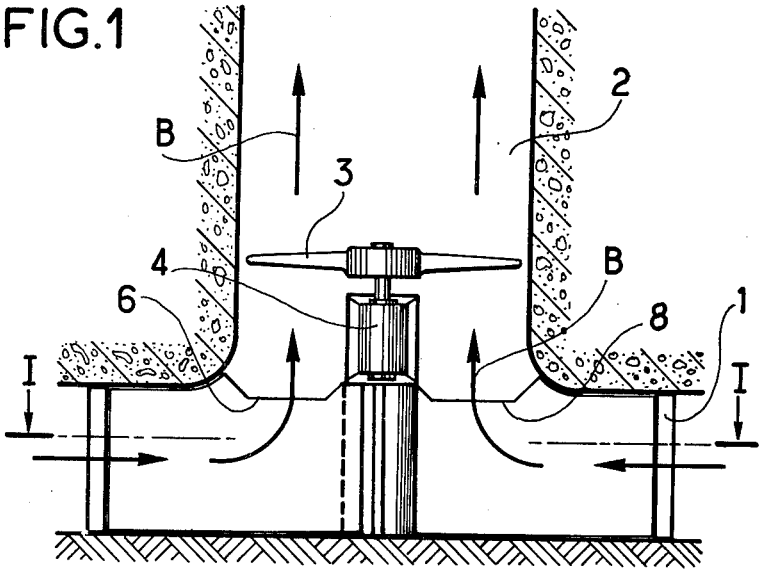
FIG. 1 is a general side view in partial section of a heat exchanger system embodying the invention.

Referring to FIG. 1, it will be seen that the assembly comprises heat exchangers 1, e.g. condensers, disposed in a radially enlarged chamber at the bottom of a chimney or cooling tower 2. A first fluid — in this case, water — flows through the condensers which are cooled by the second fluid, namely air, which passes through the condensers across the outside walls in the direction of the arrows B. The air flow is assisted by a chimney 2 and also by a fan 3 situated downstream from the condensers 1 in relation to the direction of air flow. The fan 3 is driven by a motor 4.

Figure 2:
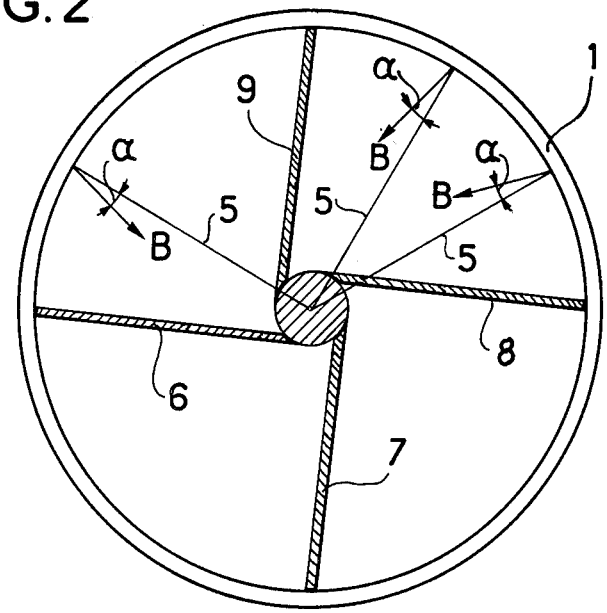
FIG. 2 is a cross-section along I—I of FIG. 1.

The condensers 1 are disposed according to the invention in such a way that the air leaves them in the direction shown in FIG. 2 by arrows B which are at an angle $\alpha$ to the local radial direction 5. The following figures show particular dispositions for obtaining this result.

FIG. 2 shows four partitions 6, 7, 8 and 9 which can be used for example to regulate the influence of outside winds and to hold the fan. These partitions must follow substantially the natural path of the fluid and they must be limited in height so as not to provoke a siren effect themselves.

Figure 3:
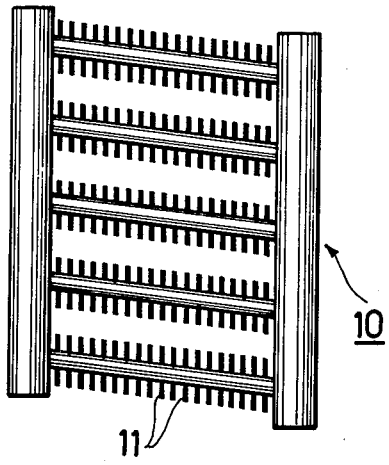
FIGS. 3 and 4 show an example of a heat exchanger arrangement embodying the invention.
Figure 4:
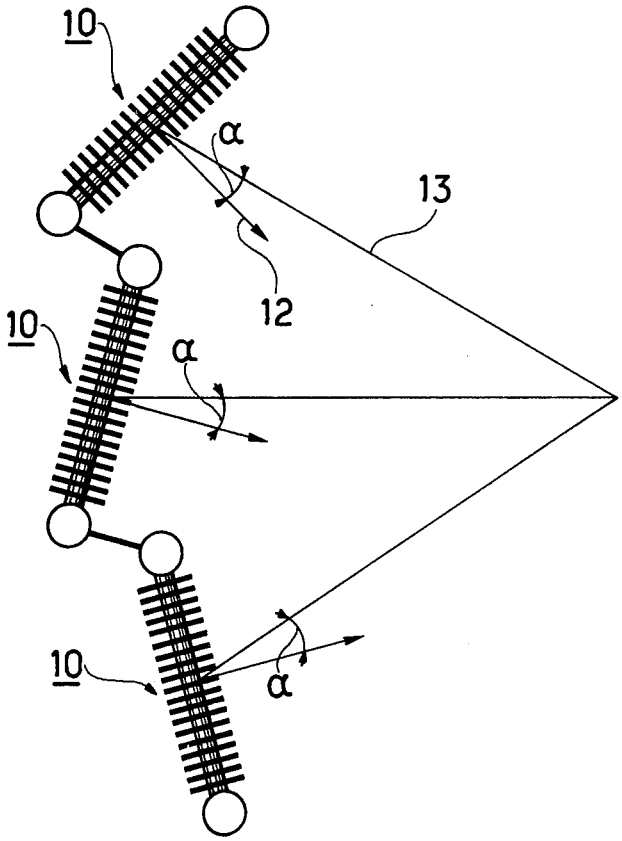

FIG. 3 shows a heat-exchanger 10 having tubes comprising fins 11 and FIG. 4 shows heat exchangers such as the one of FIG. 3 in a disposition embodying the invention. FIG. 4 also shows a perpendicular 12 drawn from the middle of the heat exchangers 10 forming an angle with a corresponding radius 13. The fins 11 thus fulfill the function of a guide for the streams of air. The heat exchangers 10 are thus disposed in this zig-zag manner round the base of the chimney 2.

Figure 5:
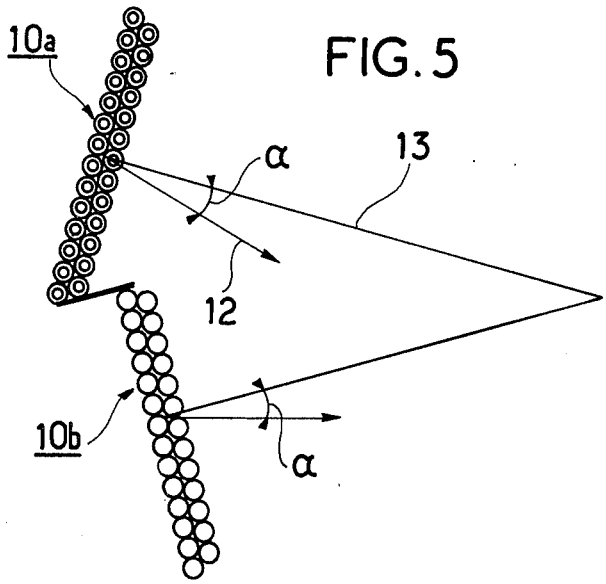
FIG. 5 shows another embodiment of the invention.

In FIG. 5, heat exchangers having vertical tubes fitted with fins (heat exchanger 10*a*) or not fitted with fins (heat exchanger 10*b*) are used. In this figure, the heat exchangers are also installed with an angle $\alpha$ between the local radius 13 and the perpendicular 12 in the middle of the heat exchangers but here, the fins do not guide the air but the disposition of the heat exchangers itself guides it.

Figure 6:
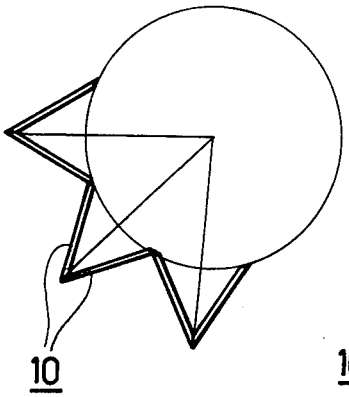
FIG. 6 is a schematic illustration of a conventional configuration of a heat exchanger when the necessary heat exchange surface is larger than the peripheral surface of the enclosure in which the heat exchangers are to be placed.

Sometimes, the complete development of the heat exchanger panels required is larger than the surface of the periphery of the enclosure in which it is required to dispose them and then a disposition which is schematized in FIG. 6 is used in which the heat exchangers 10 are placed on the sides of a triangle formed with a portion of the periphery of the tower or chimney. Such a system is known when symmetrical.

Figure 7:
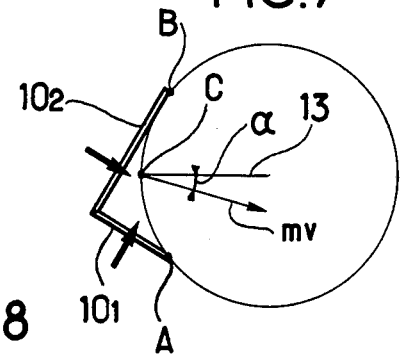
FIGS. 7 and 8 show two examples of embodiment of the invention in the case corresponding to FIG. 6.
Figure 8:
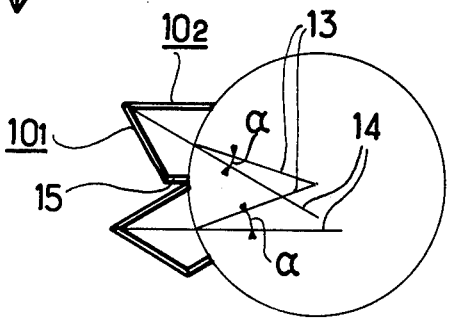

However to perform the invention the symmetry is destroyed either by using heat exchangers of different sizes as in FIG. 7 or else according to FIG. 8, by placing heat exchangers $\mathbf{10}_1$ and $\mathbf{10}_2$ symmetrically in relation to a straight line 14 at an angle $\alpha$ with the local radius 13. Partitions 15 are placed so as to block the gap between the heat exchangers such as $\mathbf{10}_2$ and $\mathbf{10}_1$.

In the case of FIG. 7 the dimensions of the exchangers $\mathbf{10}_1$ and $\mathbf{10}_2$ can be chosen so that the resultant of the quantities of movement mV of the air passing through the heat exchangers $\mathbf{10}_1$ and $\mathbf{10}_2$ form an angle $\alpha$ with the radius 13 leading to the middle C of an arc AB extending from the ends of the heat exchanger portion of the triangle.

What is claimed is:

1. In a forced flow system for heat exchange between a first fluid flowing inside ducts of a set of flat planar heat exchangers and a second fluid passing over the outside surfaces of the heat exchangers, said system including a vertical chimney terminating at its bottom in a radially enlarged chamber opening horizontally to admit air flow to said chimney, a fan placed in said chimney above said chamber and said heat exchangers positioned within said chamber such that said second fluid passes over the outside surfaces of the heat exchangers, the improvement wherein said heat exchangers are vertically oriented, are positioned within said chamber at a radial distance in excess of the radius of said chimney, constitute a circumferential array, and are angularly oriented relative to each other, and said heat exchangers including means defining horizontal air flow paths through said heat exchangers such that the streams of said second fluid emerging from the heat exchangers form on the average, in a plane perpnedicular to the axis of rotation of the fan, an angle $\alpha$ with the local radii emenating from the meeting point of said axis with said perpendicular plane, said angle $\alpha$ being calculated such that during average operation of the assembly, the angular momentum of said second fluid in relation to the axis of the fan, at the output of the heat exchangers, is substantially equal but in the opposite direction to the angular momentum imparted to said second fluid by the rotation of the fan, such that the angular momentum resulting from the second fluid in relation to the axis of the fan will be close to zero at the output of the fan.

2. An improvement according to claim 1, wherein said heat exchangers comprise substantially horizontal tubes bearing substantially vertical fins and wherein said heat exchangers are disposed in a circumferential array such that the fins define said angle $\alpha$ with said local radii.

3. An improvement according to claim 1, wherein the heat exchangers are vertical tube heat exchangers and wherein they are disposed so that a perpendicular drawn in each mid plane of each heat exchanger will form said angle $\alpha$ with the radius ending at the foot of this perpendicular.

4. An improvement according to claim 1, wherein the heat exchangers are disposed pairs around the bottom of the chimney in such that a pair of heat exchangers are contiguous along their vertical side and the mid plane of the dihedral formed by the two heat exchangers will form said angle $\alpha$ with a local radius ending in the vicinity of the middle of the arc covered by the two heat exchangers.

5. An improvement according to claim 1, wherein the heat exchangers are disposed in pairs around the bottom of the chimney, each pair comprising two exchangers of different dimensions disposed on two sides of a triangle whose third side is formed by a part of the periphery of the base of the chimney.

* * * * *